US007963364B2

(12) United States Patent
Nadler et al.

(10) Patent No.: US 7,963,364 B2
(45) Date of Patent: Jun. 21, 2011

(54) POROUS METAL BODIES USED FOR ATTENUATING AVIATION TURBINE NOISE

(75) Inventors: Jason Nadler, Decatur, GA (US); Florin Paun, Issy les Moulineaux (FR); Pierre Josso, Issy les Moulineaux (FR); Marie-Pierre Bacos, Antony (FR); Stéphane Gasser, Paris (FR)

(73) Assignee: ONERA (Office National d'Etudes et de Recherches Aerospatiales), Chatillon (FR)

( * ) Notice: Subject to any disclaimer, the term of this patent is extended or adjusted under 35 U.S.C. 154(b) by 414 days.

(21) Appl. No.: 12/087,025

(22) PCT Filed: Dec. 21, 2006

(86) PCT No.: PCT/FR2006/002823

§ 371 (c)(1),
(2), (4) Date: Dec. 10, 2008

(87) PCT Pub. No.: WO2007/077343

PCT Pub. Date: Jul. 12, 2007

(65) Prior Publication Data

US 2010/0221570 A1 Sep. 2, 2010

(30) Foreign Application Priority Data

Dec. 23, 2005 (FR) ..... 05 13263

(51) Int. Cl.
*G10K 11/16* (2006.01)

(52) U.S. Cl. ..... 181/293; 428/596; 428/613; 205/75; 29/896.6; 29/527.1

(58) Field of Classification Search ..... 181/293
See application file for complete search history.

(56) References Cited

U.S. PATENT DOCUMENTS

| | | | | |
|---|---|---|---|---|
| 1,554,180 | A * | 9/1925 | Trader | 52/144 |
| 2,652,126 | A * | 9/1953 | Mazer | 181/293 |
| 3,094,188 | A * | 6/1963 | Eustachio | 181/293 |
| 3,751,271 | A * | 8/1973 | Kimura et al. | 501/85 |
| 4,113,053 | A * | 9/1978 | Matsumoto et al. | 181/284 |

(Continued)

FOREIGN PATENT DOCUMENTS

EP 0 036 356 A1 9/1981

(Continued)

OTHER PUBLICATIONS

International Search Report, dated Jun. 14, 2007, corresponding to PCT/FR2006/002823.

*Primary Examiner* — John J Zimmerman
(74) *Attorney, Agent, or Firm* — Christie, Parker & Hale, LLP

(57) ABSTRACT

A structural element used for attenuating aviation turbine noise is provided with pores (1, 2) embodied in the form of cylindrical channels which are open on the first ends inside the turbine housing and closed on the opposite ends thereof, wherein the diameter (D) of each channel ranges approximately from 0.1 to 0.3 mm, each channel is remote at least along one part of the length thereof from the closest neighbors at a minimum distance ranging approximately from 0.02 to 0.3 mm and the ratio between the channel length and diameter thereof is of the order of $10^2$.

20 Claims, 1 Drawing Sheet

U.S. PATENT DOCUMENTS

| | | | | |
|---|---|---|---|---|
| 4,830,140 | A * | 5/1989 | Fridh et al. | 181/288 |
| 5,564,067 | A * | 10/1996 | Hendricks | 428/566 |
| 5,721,402 | A | 2/1998 | Parente | |
| 5,869,196 | A * | 2/1999 | Wong et al. | 428/613 |
| 5,962,107 | A * | 10/1999 | Lowery et al. | 428/131 |
| 2002/0139900 | A1 | 10/2002 | Porte et al. | |
| 2004/0043208 | A1 * | 3/2004 | Fukutani et al. | 428/304.4 |
| 2007/0235253 | A1 * | 10/2007 | Hiraku et al. | 181/293 |
| 2007/0272482 | A1 * | 11/2007 | Yamaguchi et al. | 181/290 |
| 2009/0166127 | A1 * | 7/2009 | Thomas et al. | 181/292 |

FOREIGN PATENT DOCUMENTS

| | | | |
|---|---|---|---|
| EP | 1 232 945 | A1 | 8/2002 |
| GB | 2 314 526 | A | 1/1998 |

* cited by examiner

POROUS METAL BODIES USED FOR ATTENUATING AVIATION TURBINE NOISE

CROSS-REFERENCE TO RELATED APPLICATION

This application is a National Phase Patent Application of International Application Number PCT/FR2006/002823, filed on Dec. 21, 2006, which claims priority of French Patent Application Number 0513263, filed on Dec. 23, 2005.

The invention relates to the manufacture of porous metal bodies.

The noise emitted by an aircraft in commercial use, chiefly due to the engines, may reach 155 dB in the immediate vicinity of the apparatus on takeoff. This level, which is above the auditory pain threshold estimated at 120 dB, is still 90 dB at a distance of 400 m from the source. It is therefore desirable to reduce this noise emission level. One way of attempting to solve this problem consists in absorbing the noise at one of its emission points, i.e. at the engines. Solutions have already been implemented in the "cold" parts of the engines, but the "hot" parts are not currently the subject of any acoustic treatment. It is therefore desirable to develop a material that has an acoustic absorption function intended for the hot parts of aircraft engines. To do this, one method envisaged is to develop an expansion nozzle capable of partly absorbing the noise produced inside the engine.

The honeycomb structures that are well known in the aviation field may be adapted to acoustic absorption. These structures are then associated with perforated skins that partly close off the constituent cells. The constituent cells, more than 1 mm in diameter, thus form resonant acoustic cavities that trap the waves passing through the perforations. These structures do not result in satisfactory acoustic properties as they are Helmholtz-type resonators that can only absorb very specific frequencies. The phenomenon brought into play is based on quarter wavelength resonance. Only frequencies with a wavelength approximately four times the depth of the constituent cells and their harmonics are effectively absorbed.

In fact, effective acoustic absorption at the expansion nozzle for the noise produced by the combustion chamber and the different bladings of the turbines and high pressure compressors implies an effect on a wide range of frequencies.

The aim of the invention is to provide a porous structure having improved acoustic properties compared with those of known structures.

The invention relates in particular to a porous metal body having two opposite main faces and adapted to attenuate the noise produced or transmitted by a current of gas sweeping over a first of said main faces, said body having pores in the form of cylindrical channels the axes of which extend substantially along straight lines perpendicular to said first face, opening out in said first face at a first one of their ends and closed off at their opposite end, each channel having a diameter of between about 0.1 and 0.3 mm and being located, over at least part of its length, at a minimal distance from its closest neighbours of between about 0.02 and 0.3 mm, and the ratio between the length and diameter of the channels being more than ten and preferably of the order of $10^2$.

The metal structure thus described has a porosity that may exceed 70%, hence a mass by volume which is compatible with aeronautical applications.

This structure behaves as an excellent noise absorber, particularly for frequencies above 1 kHz, as demonstrated by the use of conventional analytical models of acoustic absorption (propagation of an acoustic wave inside a tube by Kirchhoff in 1857).

The open cells of this "micro-honeycomb" are large enough to allow the sound wave, within the range of frequencies of the order of 1 kHz or below, to penetrate into the structure, but small enough to obtain the specific surface needed to attenuate the acoustic energy by visco-acoustic dissipation in the fluid contained within the porous material. This dissipation is due to the shearing of the fluid in the outer layer appearing on the inner walls of the porous structure For a diameter of less than 0.1 mm, the wave does not penetrate effectively into the structure. For a diameter of more than 0.3 mm, the phenomenon of quarter wavelength resonance becomes preponderant again.

The cylindrical channels with a diameter of between 0.1 and 0.3 mm promote the dissipation of the energy of the acoustic wave in the shearing inside the gas occurring in the outer layers appearing on the walls of the channels.

If the diameter of the cylindrical channels is more than 0.3 mm, the total surface area of the walls becomes insufficient.

The absorption mechanism of this new structure is due to a viscous dissipation in the gas, whereas, by comparison, a conventional acoustic absorption system uses the principle of the Helmholtz resonator which is useful only for absorbing a particular frequency and has to be combined with non-structural porous materials in order to be able to absorb a broader spectrum of frequencies.

The prior art taken as a whole tends to show that any noise absorber based on the principle of the Helmholtz resonator will necessarily be thick, as, in order to cover the entire range of frequencies to be absorbed, the resonant structure has to be associated with various other materials (honeycombs, felts, etc.) in different thicknesses. In fact, this thickness approach may lead to an excess weight which is by no means negligible.

Finally, by virtue of its architecture, the material according to the invention, unlike the solutions described in the literature, is a structural element and may be dimensioned accordingly. Moreover, thanks to the reduction in weight resulting from its porosity, its mechanical performance in relation to its apparent density is exceptional (structural characteristics of the honeycomb type). Also, its function as a noise absorber can be regarded as an additional bonus. As a result, the application of this invention to aircraft engines makes it possible to treat the noise at its point of emission without increasing the bulk.

The conventional methods of producing honeycombs (welding corrugated metal sheets or deploying pierced metal sheets) are not applicable here on account of the scale of the object. Therefore, other techniques have to be adopted. One of these techniques is based on moulding from a chemical bath of ultra-pure nickel. The shape and diameter of the hole will be determined by the mandrel used and the wall will be determined by the thickness of the chemical deposit.

Depending on the nature of the alloy desired to produce this wall, different approaches may be adopted. Once the mandrel has been made into a conductor of electricity by chemical deposition of copper, it is coated with electrolytic nickel to give it sufficient rigidity for handling purposes. Then the electrolytic deposition is completed by the depositing of powdered alloy pre-coated with a nickel-boron alloy as described in French Patent Application 05.07255 of 7 Jul. 2005 or alloy powder disposed in an organic binder as described in French Patent Application 05.07256 of 7 Jul. 2005.

Optional features of the invention, of a complementary nature or as alternatives, are recited below:

The ratio between the length and diameter of the channels is between about 90 and 110.

The surface roughness of the channels is less than 0.01 mm.

Each channel is surrounded, in a substantially uniform angular distribution, by six other channels spaced from it at a minimum spacing of between about 0.02 and 0.3 mm.

The axis of each of said channels forms an angle of less than 20° with the perpendicular to said first face at said first end.

The body comprises nickel and/or cobalt and/or an alloy thereof, notably a superalloy based on nickel and/or cobalt.

The said first face is concave.

The invention also relates to an aeronautical turbine housing comprising at least one sector consisting of a porous body as defined hereinbefore, and a method of producing a porous body of this kind, in which a plurality of wires each having a cylindrical mandrel with a diameter of between about 0.1 and 0.3 mm consisting of a material that can be destroyed by heat, surrounded by a metal-based sheath, are arranged in layers, the sheath of each wire being in contact with the sheaths of the adjacent wires in the same layer and with the sheaths of wires in the adjacent layers, and a heat treatment is carried out to eliminate the mandrels and bond the sheaths to one another, producing a metal matrix.

The process according to the invention may have at least some of the following features:

The mandrel is made of organic material.

The mandrel is made of carbon.

The sheath is at least partly formed by chemical and/or electrolytic deposition of metal on the mandrel.

The sheath is at least partly formed by gluing metal particles to the mandrel and/or to said deposit.

The metal particles are introduced into the voids between the wires before said heat treatment.

Metal particles comprise a brazed coating which during the heat treatment causes the metal particles to bond to one another and/or to the deposit.

The metal components present are bonded to one another during the heat treatment by fusion of a eutectic between their constituent metals and the carbon coming from the mandrel and/or an organic binder or adhesive.

Before the heat treatment, one end of each wire is glued to a common support plane extending perpendicularly to the axes of the wires, the support is bent into an arc shape, with the axes of the wires than extending radially, and the metal particles are introduced into the voids between the wires.

After the heat treatment, said metal matrix is machined to form said first concave face.

After the heat treatment, the traces of carbon remaining in the channels are eliminated.

The opposite end of the channels is closed off by a layer of metal applied to the corresponding face of the metal matrix.

The features and advantages of the invention are described in more detail in the description that follows, referring to the attached drawings.

Figure 1:
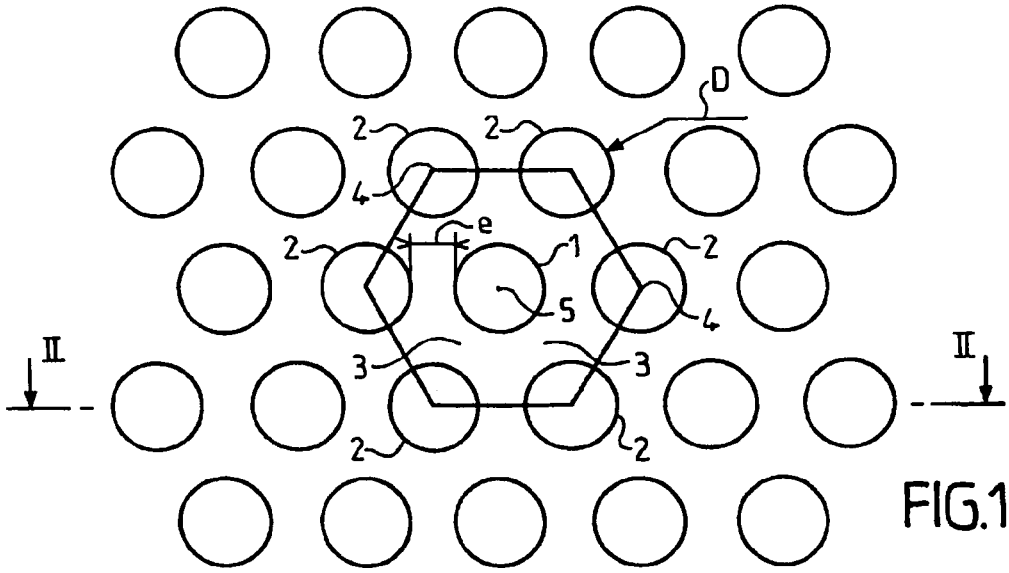
FIG. 1 is a partial view of the first main face of a porous body according to the invention.

The invention is illustrated below by means of examples. All the compositions are given by weight.

EXAMPLE 1

A porous body is to be produced from pure nickel. The mandrel used is a revolutionary cylindrical wire 0.1 mm in diameter (the method below is applicable irrespective of the diameter of the wire in question, from 1 μm to 3 mm, and whatever the shape of its cross-section). It may be, in particular, a polyamide or polyimide yarn sold as fishing line. Nickel is chemically deposited on this yarn, in accordance with the following four steps separated by copious rinsing with deionised water.

1. Preparation of the surface by degreasing and wetting.
2. Depositing tin chloride $SnCl_2$ by adsorption of a solid reducing agent, by immersing for at least 5 min in a saturated solution (5 g/l) of this salt.
3. Depositing a catalyst (palladium) on the surface to be treated, by reduction from an acid solution (pH=2) containing 10 g/l of $PdCl_2$, for at least 5 min.
4. Depositing actual nickel from a bath having the following composition:

| | | |
|---|---|---|
| nickel-triethylenediamine | $Ni(H_2NC_2H_4NH_2)_3^{2+}$ | 0.14 M |
| sodium hydroxide | NaOH | 1 M |
| arsenic pentoxide | $As_2O_5$ | $6.5.10^{-4}$ M |
| imidazole | $N_2C_2H_4$ | 0.3 M |
| hydrated hydrazine | $N_2H_4$, $H_2O$ | 2.06 M |
| pH | | 14 |

After immersion for one hour thirty minutes at 90° C., the wire is covered in a deposit of very pure nickel about 20 im thick.

This coated wire is cut into sections of suitable length, of the order of 1 cm. The different sections are then arranged parallel to one another in an aluminium crucible. The sections in a first layer rest on the flat bottom of the crucible, each one being in contact with two adjacent ones via diametrically opposite generatrices. The subsequent layers are each placed on the previous layer, in a staggered arrangement. The whole is surmounted by a weight of several tens of grams so as to keep the sections in contact with one another.

The crucible is then placed in a furnace under a vacuum greater than $10^{-3}$ Pa and heated to 400° C., a temperature at which the synthetic material of the mandrel breaks down and is ingested by the pumping system. After a levelling off of one hour, a heating gradient is carried out at 70° C./min to a temperature of 1200° C., followed by a levelling off of a quarter of an hour for each tube to interdiffuse with its two nearest neighbours. The assembly is then cooled.

At the end of this operation, a microporous object made of pure nickel is obtained, comprising pores in the form of cylindrical channels of revolution with a diameter D (FIG. 1) of about 100 μm. In the ideal case shown in the Figure, each cylindrical pore 1 has six immediate neighbours 2 from which it is separated by a wall of pure nickel 3 with a minimum thickness e of about 40 μm. The channels 2 are arranged in a uniform angular distribution, i.e. the lines 4 of their axes in the plane of FIG. 1 are located at the apices of a regular hexagon the centre of which is the line 5 of the axis of the channel 1. In reality, the arrangement of the channels may be less regular.

EXAMPLE 2

A long length of the synthetic wire used in Example 1 is wound onto a polytetrafluoroethylene (PTFE) assembly comprising six parallel cylindrical bars the axes of which are arranged, in straight projection, along the apices of a regular hexagon. Then copper is chemically deposited on this wire, according to the following four steps separated by copious rinsing with deionised water.

1. Preparation of the surface by degreasing and wetting.
2. Depositing tin chloride, $SnCl_2$, by adsorption of a solid reducing agent, by immersing for at least 5 min in a saturated solution (5 g/l) of this salt.
3. Depositing a catalyst (silver) on the surface to be treated, from a neutral solution containing 10 g/l of AgNO3, for at least 5 min.
4. Depositing actual copper from a bath having the following composition:

| | | |
|---|---|---|
| copper sulphate | $CuSO_4$, $6H_2O$ | 0.1 M |
| formaldehyde | HCHO | 0.5 M |
| double tartrate of sodium and potassium | $KNaC_4H_4O_6$, $4H_2O$ | 0.4 M |
| sodium hydroxide | NaOH | 0.6 M |

After 30 minutes the wire has taken on the characteristic red colour of a copper deposit.

After this operation, the wire which is now a conductor of electricity is plunged into a conventional bath for electrolytic nickel deposition and connected to the cathode. After 20 mins' deposition under a current density of 3 A/dm$^2$ the wire is covered with 20 μM of pure nickel.

The wire thus coated is cut into sections of suitable length. These sections are then covered with a thickness of about 100 μM of a mixture of 80 parts of powdered nickel superalloy marketed under the name IN738 and 20 parts of a binder which is itself made up of equal parts of an epoxy adhesive and ethyl alcohol as diluent, this operation being carried out by rolling the sections in the presence of the mixture of powder and binder between a flat support surface and a flat support plate, the distance between these two plates determining the thickness of the powder deposit.

The sections thus covered are then arranged in a crucible, which is in turn placed in a vacuum furnace as described in Example 1.

While the temperature is maintained at 400° C., the materials of the mandrel and the binder break down and are ingested by the pumping system. The decomposition of the adhesive leads to carbon residues being deposited on the surface of each grain of superalloy powder. After a levelling off of one hour, a new heating gradient is carried out at 70° C./min to a temperature of 1320° C., followed by a levelling off of a quarter of an hour for each grain of powder to interdiffuse with its nearest neighbours and each tube to interdiffuse with its nearest neighbours. The assembly is then cooled.

At the end of this operation, a microporous object made of alloy 1N738 is obtained.

Each pore measures about 100 to 300 μm in diameter and is separated from the adjacent pores by a wall of superalloy of about 200 μm.

EXAMPLE 3

The same method is used as in Example 2 to obtain a wire coated with 20 μm of nickel cut into sections.

In addition, a brazing layer based on nickel-boron alloy less than 1 μm thick is deposited on the grains of a powdered nickel superalloy marketed under the name Astrolloy, 10 μm in diameter, by the technique described in FR 2777215, and the powder thus coated is mixed with 1% methyl methacrylate marketed under the name Coatex P90, optionally diluted with water to render the mixture workable. The sections of nickel-plated wire are rolled in this mixture as described in Example 2 to receive a layer of about 100 μm of coated superalloy powder.

The sections thus covered are then arranged in a crucible, which is in turn placed in a furnace under vacuum as described in Example 1.

While the temperature is maintained at 400° C., the material of the mandrel breaks down. After a levelling off of one hour, a heating gradient is carried out at 70° C./min to a temperature of 1120° C., followed by a levelling off of a quarter of an hour for each grain of powder to be brazed with its nearest neighbours and for each tube to be brazed with its nearest neighbours. The assembly is then cooled.

Thus, a simple heat treatment both brazes the grains of powder to one another and also brazes the tubes to one another. As a result of the chemical deposition of nickel-boron alloy on the superalloy powder, the walls of the tube obtained after annealing are dense and homogeneous. The grains of powder are brazed to one another.

At the end of this operation, a microporous object made of Astrolloy is obtained. Each pore measures about 100 to 300 μm in diameter and is separated from the adjacent pores by a wall of superalloy of about 200 μm.

EXAMPLE 4

Roves of fibres known as pyrolysed cotton are used as the mandrel, i.e. carbon roves obtained by carding the natural cotton and pyrolysing it under reduced argon pressure, these roves being about 0.1 mm in diameter.

The fibres are nickel-coated beforehand by a technique known as the "barrel" method in a conventional bath of nickel sulphamate. The electrolysis is carried out for the time needed to obtain a thickness of nickel of between about 20 and 40 μm. The nickel-coated roves are then cut into sections which are mixed with the diluted epoxy adhesive used in Example 2 in a proportion of about 95% of roves to 5% of adhesive and arranged parallel to one another in a PTFE mould. After the adhesive has cured, a highly porous assembly is obtained. By injection using a syringe, this assembly is then impregnated with the mixture of coated Astrolloy superalloy powder and Coatex P90 used in Example 3. After drying in a drying chamber at 90° C., the material is placed in a vertical furnace under hydrogen preheated to 800° C. It is then subjected to a temperature gradient of 5° C. per minute until it reaches a temperature of 1100° C. Two concomitant phenomena then occur: the nickel-boron brazing with which the grains of Astrolloy powder are coated melts, with the result that the grains of powder are brazed to one another, and the carbon of the roves reacts with the hydrogen of the atmosphere of the furnace to form methane. After a period of 8 hours and cooling under hydrogen to a temperature of about 500° C., then a return to ambient temperature under argon, a microporous object is obtained having pores about 0.1 mm in diameter, separated by walls varying in thickness between 50 and 200 μm, while other smaller pores may arise from the interstices between the coated fibres.

Figure 2:
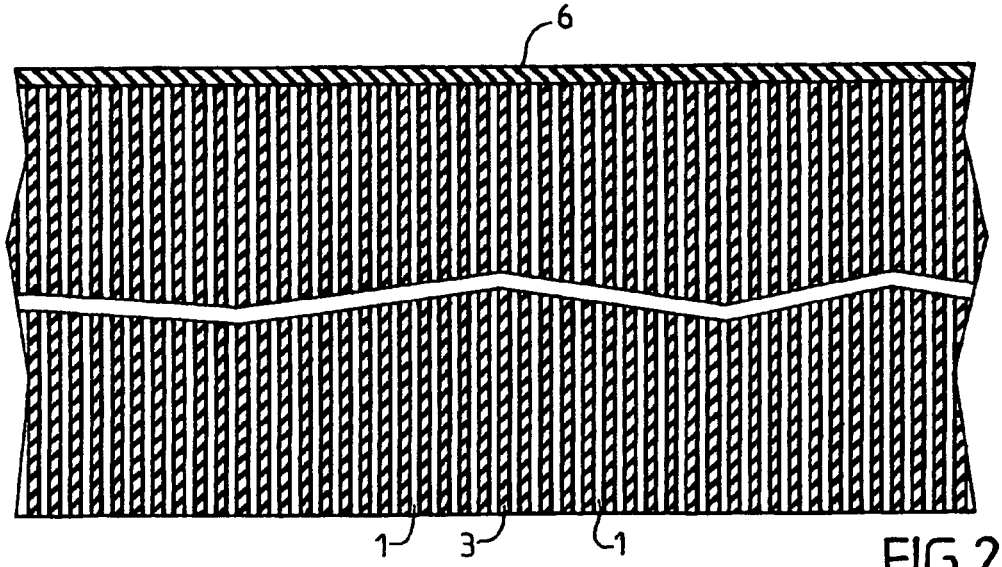
FIG. 2 is a partial view of the body, in section on the line II-II in FIG. 1.

Each of Examples 1 to 4 provides a porous body having two planar opposing main faces, the thickness of which is equal to the length of the sections of wire used, of the order of 1 cm, taking into account the ratio to be adhered to with the diameter of the wire, and comprising cylindrical pores 1 perpendicular to these two faces and opening out onto them. Thus, a flat porous body may be obtained according to the invention, the pores of which are closed off at one end, covering one of the main faces of a continuous metal layer 6 (FIG. 2), for example in the form of a sheet 0.5 mm thick brazed to the based member, or by filling the pores with a metal powder in suspension, by coating or spraying.

It is also possible to produce a sector of an aircraft turbine housing according to the invention by machining the base member to obtain one surface with a profile in the form of a convex arc and one surface with a profile in the form of a concave arc, the closing off of the pores then being carried out on the convex surface. In this case the length of the wire sections must be greater than the thickness of the sector which is to be obtained, and the axes of the channels are only perpendicular to the concave surface half-way along the arc, and have an increasing inclination relative to the perpendicular as they approach each end of the arc.

EXAMPLE 5

The aim here is to produce a sector of a housing for an aircraft turbine, without having to carry out the machining needed in the previous examples. A housing with an internal diameter of about 1 meter is divided into 12 sectors, for example. Sections of nickel-coated wire prepared as in Example 3 and cut to a suitable length are arranged vertically on a horizontal plate of PTFE having a thickness of about 1 mm, the length and width being equal, respectively, to the arc length and axial length of the sector that is to be produced. With the total surface of the plate being covered by the sections of nickel-coated wire, the ends of these sections are attached thereto with a cyanoacrylate-type adhesive. Once the adhesive has polymerised, the sheet of PTFE is bent, so that the sections of wire extend radially outwards and have a mutual spacing in the circumferential direction which increases starting from the sheet, the nickel coating ensuring that the sections are kept rigid. The voids thus formed are filled with the mixture of coated Astrolloy superalloy powder and Coatex P90 used in Example 3, while this powder may be partly replaced by hollow nickel spheres such as the spheres roughly 0.5 mm in diameter sold by ATECA. After drying in the drying chamber overnight at 70° C., the sheet of PTFE is removed, while the assembly of fibres, powder and adhesive has become mechanically solid. The assembly is placed in a furnace under vacuum. When the pressure in the enclosure is below about $10^{-3}$ Pa, the assembly is heated to a temperature of 450° C. for 1 hour for degassing and elimination of the organic products (mandrel and methyl methacrylate). The decomposition of the methacrylate causes carbon residues to be deposited on the surface of each grain of superalloy powder. A new heating gradient is carried out at 70° C./min to a temperature of 1320° C., followed by a levelling off of a quarter of an hour for each grain of powder to interdiffuse with its nearest neighbours and for each tube to interdiffuse with its nearest neighbours. The assembly is then cooled. As in the previous Examples, the Ni-carbon eutectic has acted as a brazing solder and ensured that the grains of powder are joined together and has then solidified as a result of the diffusion of the carbon into the alloy. After cooling, a porous body 10 is obtained (FIG. 3) in the form of an arc of a circle crisscrossed by a plurality of channels 11 with a diameter of 0.1 mm, separated from one another by walls 12 with a minimum thickness of several hundredths of a millimeter, in the vicinity of the concave face of the body and several tenths of a millimeter in the vicinity of its convex face. The pores are then closed off by a metal layer 13 analogous to the layer 6 in FIG. 2, applied to the convex face.

Figure 3:
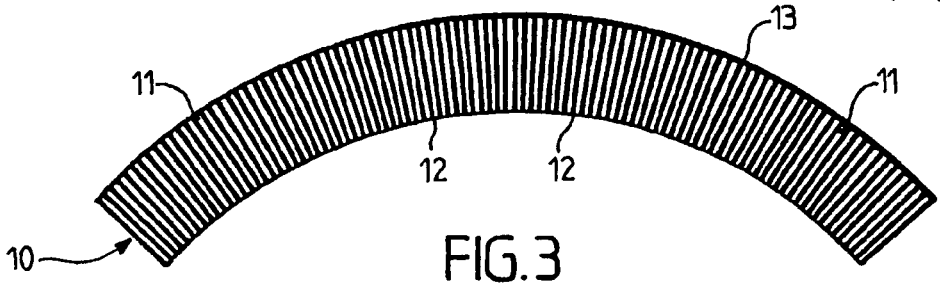
FIG. 3 is a sectional view of a sector of an aeronautical turbine housing according to the invention.

Sectors such as the one shown in FIG. 3 may be used over the entire periphery of the housing, or over only part of it.

Although a wire of circular cross-section has been used as the mandrel in the Examples above, on account of its availability, it is also possible to use a mandrel of non-circular, notably polygonal, cross-section.

If necessary, ultrasonic treatment of the porous body may be carried out to eliminate the traces of carbon that remain after heat treatment on the walls of the channels and thereby obtain a very smooth surface.

The invention claimed is:

1. Porous metal body having two opposite main faces and adapted to attenuate the noise produced or transmitted by a current of gas sweeping over a first of said main faces, said body having pores (1, 2) in the form of cylindrical channels the axes of which extend substantially along straight lines perpendicular to said first face, opening out in said first face at a first one of their ends and closed off at their opposite end, each channel having a diameter (D) of between about 0.1 and 0.3 mm and being located, over at least part of its length, at a minimal distance (e) from its closest neighbours of between about 0.02 and 0.3 mm, and the ratio between the length and diameter of the channels being more than 10.

2. Porous body according to claim 1 wherein the ratio between the length and diameter of the channels is between about 90 and 110.

3. Porous body according to claim 1, wherein the surface roughness of the channels is less than 0.01 mm.

4. Porous body according to claim 1, wherein each channel (1) is surrounded, in a substantially uniform angular distribution, by six other channels (2) spaced from it at a minimum spacing of between about 0.02 and 0.3 mm.

5. Porous body according to claim 1, wherein the axis of each of said channels forms an angle of less than 20° with the perpendicular to said first face at said first end.

6. Porous body according to claim 1, comprising nickel and/or cobalt and/or an alloy thereof, notably a superalloy based on nickel and/or cobalt.

7. Porous body according to claim 1, wherein the said first face is concave.

8. Aircraft turbine housing comprising at least one sector consisting of a porous body according to claim 7.

9. Process for producing a porous body according to claim 1, in which a plurality of wires each having a cylindrical mandrel with a diameter of between about 0.1 and 0.3 mm consisting of a material that can be destroyed by heat, surrounded by a metal-based sheath, are arranged substantially along straight lines parallel to one another, the wires being arranged in rows and the sheath of each wire being in contact with the sheaths of the adjacent wires in the same layer and with the sheaths of wires in the adjacent rows, and a heat treatment is carried out to eliminate the mandrels and bond the sheaths to one another, producing a metal matrix.

10. Process according to claim 9, wherein the mandrel is made of organic material.

11. Process according to claim 9, wherein the mandrel is made of carbon.

12. Process according to claim 9, wherein the sheath is at least partly formed by chemical and/or electrolytic deposition of metal on the mandrel.

13. Process according to claim 9, wherein the sheath is at least partly formed by gluing metal particles to the mandrel and/or to the sheath.

14. Process according to claim 9, wherein metal particles are introduced into the voids between the wires before said heat treatment.

15. Process according to claim 9, wherein metal particles comprise a brazed coating around the mandrel which during the heat treatment causes the metal particles to bond to one another and/or to the sheath.

16. Process according to claim 9, wherein metal components present are bonded to one another during the heat treatment by fusion of a eutectic between their constituent metals and the carbon coming from the mandrel and/or an organic binder or adhesive.

17. Process according to claim 9 for producing a porous body, wherein, before the heat treatment, one end of each wire is glued to a common support plane extending perpendicularly to the axes of the wires, the support is bent into an arc shape such that the first face is concave, with the axes of the wires then extending radially, and metal particles are introduced into the voids between the wires.

18. Process according to claim 9 for producing a porous body, wherein, after the heat treatment, said metal matrix is machined to form the first face, wherein the first face is concave.

19. Process according to claim 9, wherein, after the heat treatment, traces of carbon remaining in the channels are eliminated.

20. Process according to claim 9, wherein the opposite end of the channels is closed off by a layer of metal applied to the corresponding face of the metal matrix.

* * * * *